US006260305B1

(12) United States Patent
Joyce

(10) Patent No.: US 6,260,305 B1
(45) Date of Patent: Jul. 17, 2001

(54) GASKET SYSTEM FOR A HORIZONTAL DOOR

(75) Inventor: Roger F. Joyce, Guilford, CT (US)

(73) Assignee: The Bilco Company, West Haven, CT (US)

( * ) Notice: Subject to any disclaimer, the term of this patent is extended or adjusted under 35 U.S.C. 154(b) by 0 days.

(21) Appl. No.: 09/057,293

(22) Filed: Apr. 8, 1998

(51) Int. Cl.[7] ..... E06B 7/232
(52) U.S. Cl. ..... 49/496.1; 49/489.1
(58) Field of Search ..... 49/490.1, 489.1, 49/501, 504, 226, 368, 304, 496.1

(56) References Cited

U.S. PATENT DOCUMENTS

| | | | | |
|---|---|---|---|---|
| 1,570,186 | * | 1/1926 | Replogle | 49/489.1 |
| 2,051,757 | * | 8/1936 | Travis | 49/489.1 |
| 2,077,845 | * | 4/1937 | Madsen | 49/489.1 |
| 2,293,292 | * | 8/1942 | Goellner | 49/489.1 |
| 2,918,710 | * | 12/1959 | Sitterly et al. | 49/496.1 |
| 2,929,446 | * | 3/1960 | Kuehnlein | 49/496.1 |
| 3,385,001 | * | 5/1968 | Bordner | 49/496.1 |
| 3,896,595 | | 7/1975 | Anghinetti et al. | 52/19 |
| 4,115,968 | | 9/1978 | Majumdar | 52/204 |
| 4,157,634 | | 6/1979 | Coulston | 49/489.1 |
| 4,346,932 | | 8/1982 | Iwata et al. . | |
| 4,462,190 | | 7/1984 | Allen | 52/58 |
| 4,523,785 | | 6/1985 | Draper et al. . | |
| 4,709,959 | | 12/1987 | Paerisch et al. . | |
| 4,720,936 | | 1/1988 | Ellingson | 49/489.1 |
| 4,807,397 | * | 2/1989 | Doan | 49/489.1 |
| 4,930,257 | | 6/1990 | Windgassen | 49/496.1 |
| 4,991,352 | | 2/1991 | Hyer | 49/489.1 |
| 5,055,335 | | 10/1991 | Wicks | 49/504 |
| 5,363,596 | | 11/1994 | Kronbetter . | |
| 5,499,475 | | 3/1996 | Court et al. | 49/490.1 |
| 5,600,921 | | 2/1997 | Vardaro | 49/380 |
| 5,638,645 | | 6/1997 | Lipton | 52/72 |

FOREIGN PATENT DOCUMENTS

| | | |
|---|---|---|
| 0 209 453 | 1/1987 | (EP) . |
| 2 136 484 | 9/1984 | (GB) . |
| 2 230 811 | 10/1990 | (GB) . |
| 2 250 774 | 6/1992 | (GB) . |
| 2 265 651 | 10/1993 | (GB) . |
| 94/08124 | 4/1994 | (WO) . |

* cited by examiner

*Primary Examiner*—Daniel P. Stodola
*Assistant Examiner*—Curtis Cohen
(74) *Attorney, Agent, or Firm*—DeLio & Peterson, LLC

(57) ABSTRACT

Horizontal hinged door assemblies such as sidewalk doors comprising a door, a frame surrounding the door and a hinge connecting the door to the frame are improved by utilizing a bendable gasket having a leg portion which is preferably inserted into an opening in at least one of the frame walls to secure the gasket to the frame and an outwardly and preferably downwardly extending body portion which extends across a gap between the frame and the edge of the door when closed and which is contacted by the door and bent further downward when the door is closed. The bendable gasket may be inserted into and secured to the frame during fabrication of the door assembly or on-site during installation of the door assembly. A variety of elongated shaped bendable gaskets may be used depending on the type door assembly installation.

5 Claims, 3 Drawing Sheets

GASKET SYSTEM FOR A HORIZONTAL DOOR

BACKGROUND OF THE INVENTION

1. Field of the Invention

This invention relates to horizontal hinged door assemblies such as sidewalk access doors and, in particular, to a gasket system for such door assemblies which comprise a door, a frame surrounding the door, preferably a peripheral channel frame to prevent water and dirt from falling through to the area below covered by the door, and a hinge connecting the door to the frame for rotation about an axis, the gasket system restricting water and dirt from entering a gap between the frame and the edge of the door.

2. Description of Related Art

Horizontal hinged (covers) doors are commonly used for access doors, roof scuttles, automatic fire vents, ceiling access doors, basement doors and for pit, floor and sidewalk doors for access to subterranean locations. While the present description will be directed to pit, floor and sidewalk doors, it will be appreciated that the invention can be used for any such horizontal doors, such as angled bulkhead doors for entering or leaving a basement, where there is a gap between the frame of the door and the edge of the door through which gap water or dirt may enter.

Pit, floor and sidewalk doors are used in a variety of applications for providing access through openings in a concrete slab, wood floor or ceiling, and the like into a pump pit, utility vault, pipe trench, basement, building, etc. Most of the designs for these type doors utilize a channel frame surrounding the door which frame may be connected to a drain. The typical door assembly necessarily has a small gap between the frame and the edge of the door through which water and dirt enters and the drain directs rain water away and the channel restricts dirt from falling through to the covered area below.

The channel frame is usually made of ¼ metal such as extruded aluminum and is generally a U-shape. The thickness of the frame is usually up to about ½ inch, typically ¼ inch. The dimensions of the U-shape channel may vary widely up to, for example, 5 inch high by 5 inch wide or larger. A typical U-frame is made of ¼ inch thick extruded aluminum with the frame being about 3.5 inch high by 3 inch wide. The channel frame is made as a continuous extrusion and is cut to the proper length and the four sides of the assembly connected together to form the frame. The frame is positioned at the periphery of the hole opening to which the frame is secured. The top of the outer wall of the channel frame typically has an inward flange extending around the periphery of the channel for strength and to facilitate hinge connection to the door. The height of the inner wall of the frame is generally slightly lower than the outer wall to accommodate the thickness of the door when the door is closed. The door is generally up to about ⅜ inch thick, typically ¼ inch. When the door is in the closed position, the door rests on the inner wall and the door is flush with the inward flange of the channel frame.

The door covers an opening and there is necessarily a gap due to manufacturing tolerances and operational clearances between the edges of the door and the frame of the door assembly. It is important to keep rain water, dirt and other debris from entering the gap and falling into the frame and/or opening covered by the door assembly. Additionally, dirt and debris can accumulate in the frame or on the frame walls lifting the door above the sidewalk or floor level causing a tripping hazard and possible hinge and door damage.

In a prior art horizontal door assembly shown in FIG. 3, a gasket 43 is used between two confronting surfaces comprising the door 14 and flange 42 of the channel frame 40. The top portion 44 of gasket 43 is compressed between the door 14 and channel flange 42. This type design has certain drawbacks such as a need for continual maintenance of the gasket, the buildup of dirt on the gasket surface and the need for a confronting flange to support the gasket.

Bearing in mind the problems and deficiencies of the prior art, it is one object of the present invention to provide a bendable gasket structure for use with a horizontal door to restrict water, dirt and debris from entering a gap between the door frame and edges of the door.

It is an additional object of the invention to provide a horizontal hinged door assembly having a bendable gasket structure as part of the assembly which gasket restricts water, dirt and debris from entering a gap between the door frame and edges of the door.

It is another object of the invention to provide a horizontal hinged door assembly and/or a frame member used to make horizontal door assemblies which are adapted to utilize a bendable gasket structure of the invention which gasket extends across a gap between the door frame and edges of the door to restrict water, dirt and debris from entering the gap.

Other objects and advantages will be apparent from the following description.

SUMMARY OF THE INVENTION

The present invention comprises a horizontal hinged door assembly for enclosing an opening, the door assembly comprising:

- a plurality of elongate frame members, preferably comprising a channel frame and is generally U-shaped, which frame members are connected together to form a frame for the door assembly, the frame members preferably having opposed outer and inner walls and a connecting lower wall and at least one opening or recess in the inner surface of the outer wall of at least one of the frame members and preferably in all of the frame members with the opening opposed to the edge of the door when closed;
- a hinge;
- a door hingedly mounted to a frame member for motion between an open and closed position wherein when the door is in the closed position there is a gap between the outer wall of the frame and the edge of the door; and
- an elongate bendable gasket preferably comprising a leg portion which is inserted into any of the frame openings to secure the gasket to the frame and a body portion which extends outwardly from the wall of the frame member and which body portion of the gasket extends across the gap and is bent downwardly by the door when the door is in the closed position.

The frame member is preferably a channel frame and is generally U-shaped and preferably has a transverse inwardly extending flange at the upper end of the outer wall which extends partially into the channel opening formed by the channel frame and which flange contains the recess to hold the gasket. The frame member may comprise other shapes as is well known in the art. The height of the inner wall of the channel frame is slightly lower than the height of the outer wall to accommodate the door when closed so that the closed door is flush with the upper end and flange of the outer wall of the channel frame.

The gasket device is of a material and thickness sufficient to provide the necessary strength for sealing the door over a long period of use. The gasket devices are preferably a resilient material such as an elastomer, rubber, polymer, etc. The shape of the gasket will vary depending on the desired configuration and generally comprises a leg portion which is inserted into an opening of the frame member to secure the gasket to the frame and a body portion which extends outward from the frame member and preferably downward from the plane of the closed door so that dirt or other debris will not settle and remain on the gasket surface when the door is open. The gasket device and especially the body portion is bendable by the door and covers a gap between the door frame and edge of the door and the gasket is preferably secured to the frame member by inserting the leg portion of the gasket device into the frame member of the door assembly.

In a further aspect of the invention, a bendable gasket device is provided for use to cover a gap in a horizontal door between the door frame and door edge wherein preferably a leg portion of the gasket device is inserted into an opening in the frame member and a body portion of the device extends outward from the wall and is bendable by the door when closed.

In an additional aspect of the invention, the opening or recess in the frame member is preferably a longitudinal slot running the length of the frame member so that the gasket device can preferably be continuous along the length of the frame member or one or more gasket devices inserted at any point along the length of the frame member. This type frame member design is economical from a manufacturing standpoint because the frame member would be extruded as a continuous member with the slot therein.

BRIEF DESCRIPTION OF THE DRAWINGS

For a full understanding of the invention, reference should be made to the following description taken in connection with the accompanying drawings in which.

DESCRIPTION OF THE PREFERRED EMBODIMENT

Figure 1:
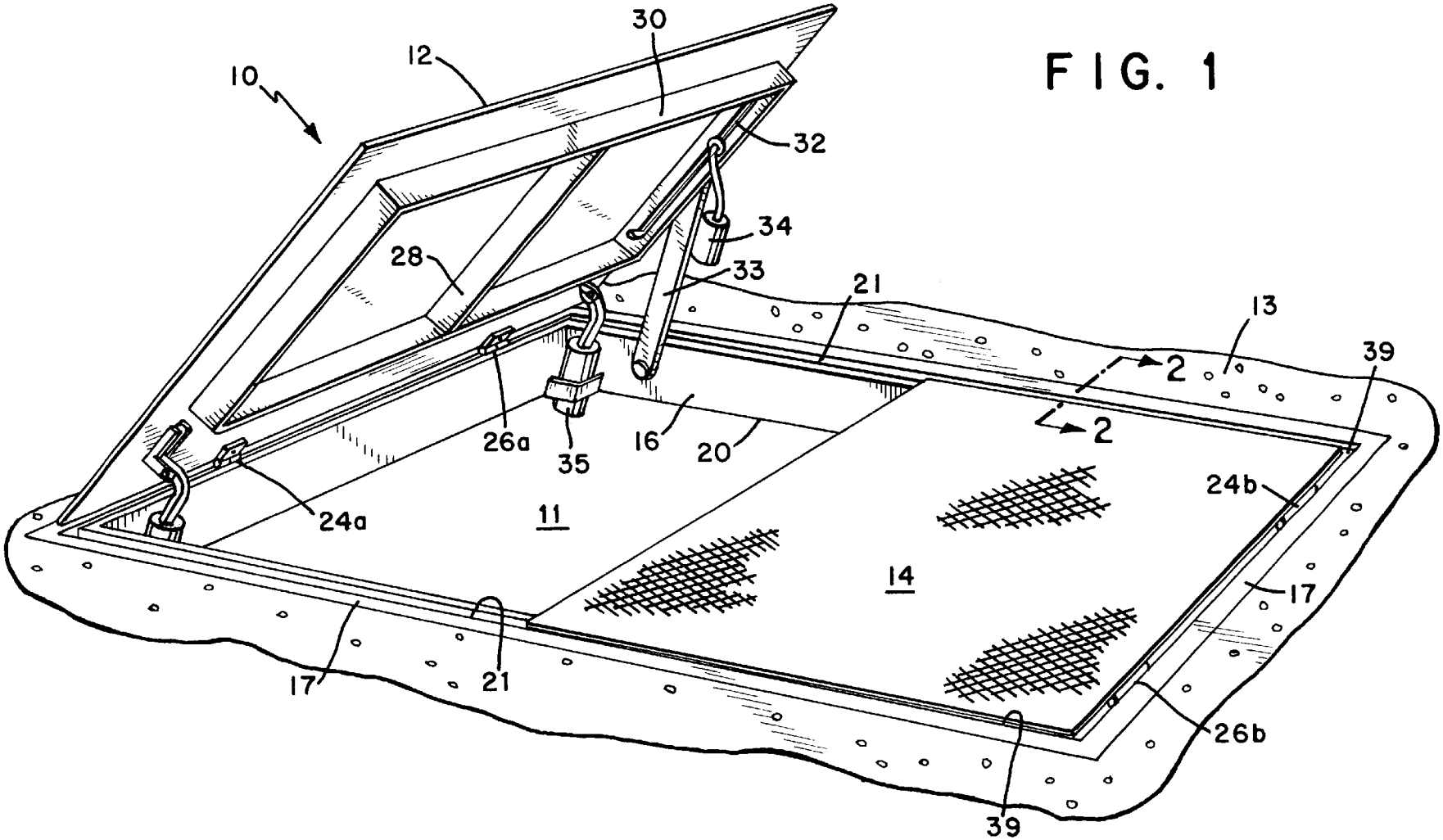
FIG. 1 is a perspective view of a double leaf, flush mounted door assembly, one leaf being open to show the peripheral channel frame member.

Referring to FIG. 1, a horizontal double leaf door assembly for enclosing an opening 11 according to the present invention is generally indicated by reference no. 10. The assembly is shown cast-in-place in a concrete floor 13 which floor is at the same level as the door leafs 12 and 14. One door leaf 12 is open to show the internal support structure and counterbalancing mechanism typical of these type door assemblies. Door leaf 14 is shown in the closed position. Door leaf 12 is shown horizontally hinged to flange 17 of an outer wall of channel frame 20 with hinges 24*a* and 26*a* and supported by spring lift mechanism 35. Inner wall 16 is lower than flange 17 and outer wall 15 (not shown) to accommodate the thickness of the door leaf 12 or 14. Door leaf 12 is shown with cross ribs 28 and long ribs 30 for support and L-slot 32 is provided to engage door handle 34, which is connected to support strut 33. Door leaf 14 is shown hinged to channel frame 15 by hinges 24*b* and 26*b*. A gap 39 is typically between the end of shoulder 17 and the edge of door 14 due to manufacturing tolerances and operational clearances to facilitate opening and closing the door. The gap 39 typically extends around the periphery of the door and it is through this gap that rain water, dirt and debris enter the channel opening 21 and the opening 11 covered by the door assembly 10. The invention may also be used with single leaf doors as will be apparent to those skilled in the art.

Figure 2:
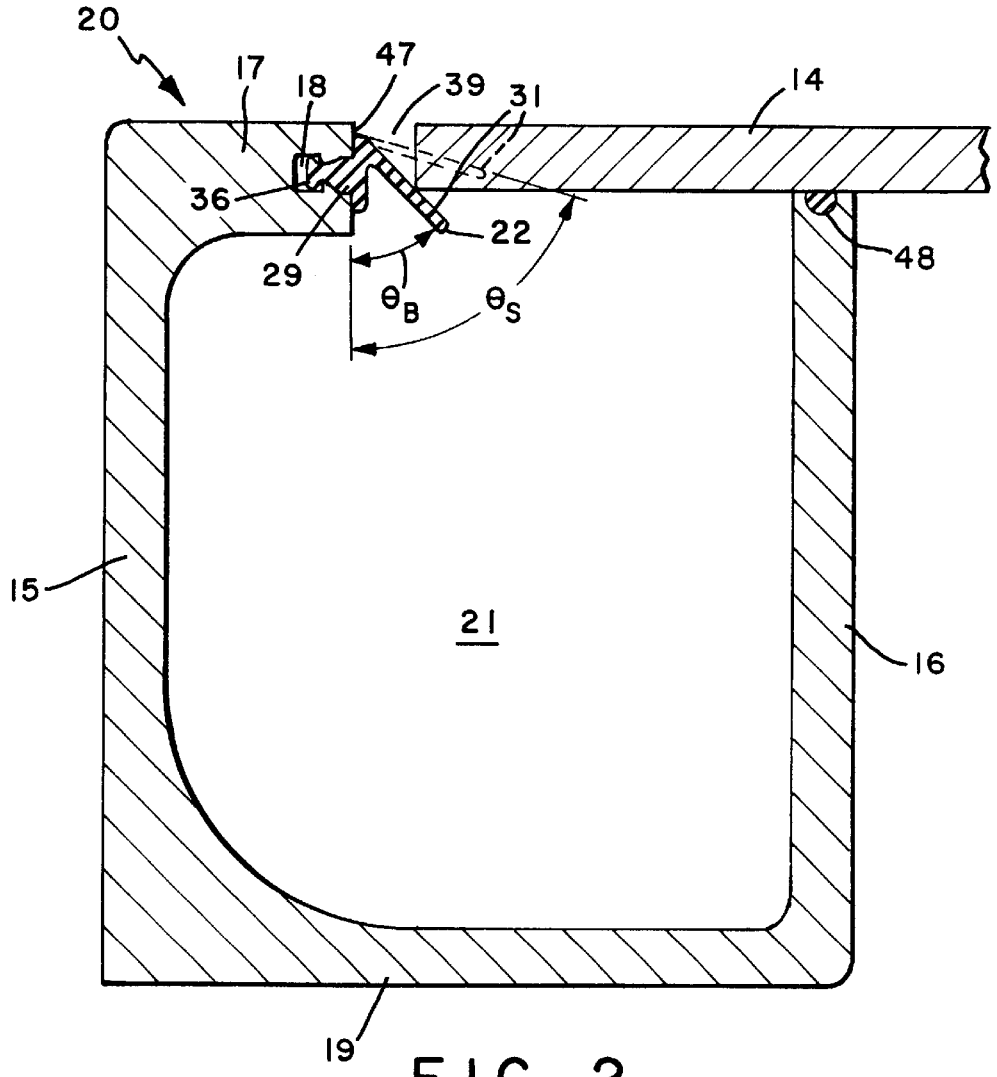
FIG. 2 is a partial cross-sectional side view along the line 2—2 in FIG. 1 showing the channel frame modified according to the present invention to accommodate a gasket of the invention.

Referring to FIG. 2, door leaf 14 can be seen in the closed position. Channel frame 20 has a channel 21 formed by outer wall 15, opposed inner wall 16 and a connecting lower wall 19. The frame 20 extends around the periphery of the opening and the frame is generally formed by connecting frame members 20 together by welding at the corners. The outer wall 15 has on the upper end thereof, an inwardly extending flange 17 and a gap 39 is typically formed between the end of flange 17 and the edge of door 14.

Leg portion 29 of gasket 22 is shown inserted in frame member opening 18 in flange 17. A body portion 31 of the gasket extends outward from the end of flange 17 of the channel frame 20. The body portion 31 is shown in a bent position at angle $\theta_B$ resulting from the edge of door 14 contacting and forcing body portion 31 downward. Body portion 31 is shown in phantom in the relaxed non-bent position. The body portion 31 in the relaxed position is also preferably angled downwardly shown as angle $\theta_s$ so that dirt, water, etc. do not accumulate on the surface of the gasket.

The channel frame 20 is preferably constructed with a thicker flange ∫in which gasket openings 18 are to be provided. The wall portion 47 of the flange 17 is of a thickness sufficient to support the gasket and typically will be ¼ to ½ inch thick or more. The leg portion 29 of the gasket may vary widely and is generally up to about ½ inch long and preferably about ⅛ to ¼ inch long. The length of the body portion will likewise vary widely to extend across the gap and will generally be up to about ½ inch in length, usually 3⁄16 to ⅜ inch. The opening 18 and leg portion 29 are configured to lock the leg portion into the opening to secure the gasket to the frame. The gap 39 between the frame and door edge may vary and is usually about ⅛ to ¼ inch. A gasket 48 is typically disposed at the top of inner wall 16 to provide an additional seal between the door and channel frame.

The gasket 22 shown in FIG. 2 comprises a downwardly angled body portion 31 and a shorter horizontal leg portion 29. Leg portion 29 has a protrusion 36 at the back end thereof to provide a force fit with a corresponding shoulder in the frame opening 18. In use, gasket 22 would be secured in channel frame 20 by forcing leg portion 29 into the frame opening 18.

As seen from the drawings, the door assembly of the present invention may be conventionally manufactured with the exception that the channel frame contains openings or recesses which are preferably formed in the frame member manufacturing (extrusion) process. The openings are preferably slots which run the length of the frame and which are easily made during an extrusion process forming the frame member. The gasket 22 is manufactured separately and attached to the door assembly on-site by the installer or during fabrication of the door assembly. The gasket typically runs the length of the frame member or a plurality of gaskets may be used along the length of the frame member such as when the wall of the frame member containing the opening is obstructed by the hinges.

Figure 3:
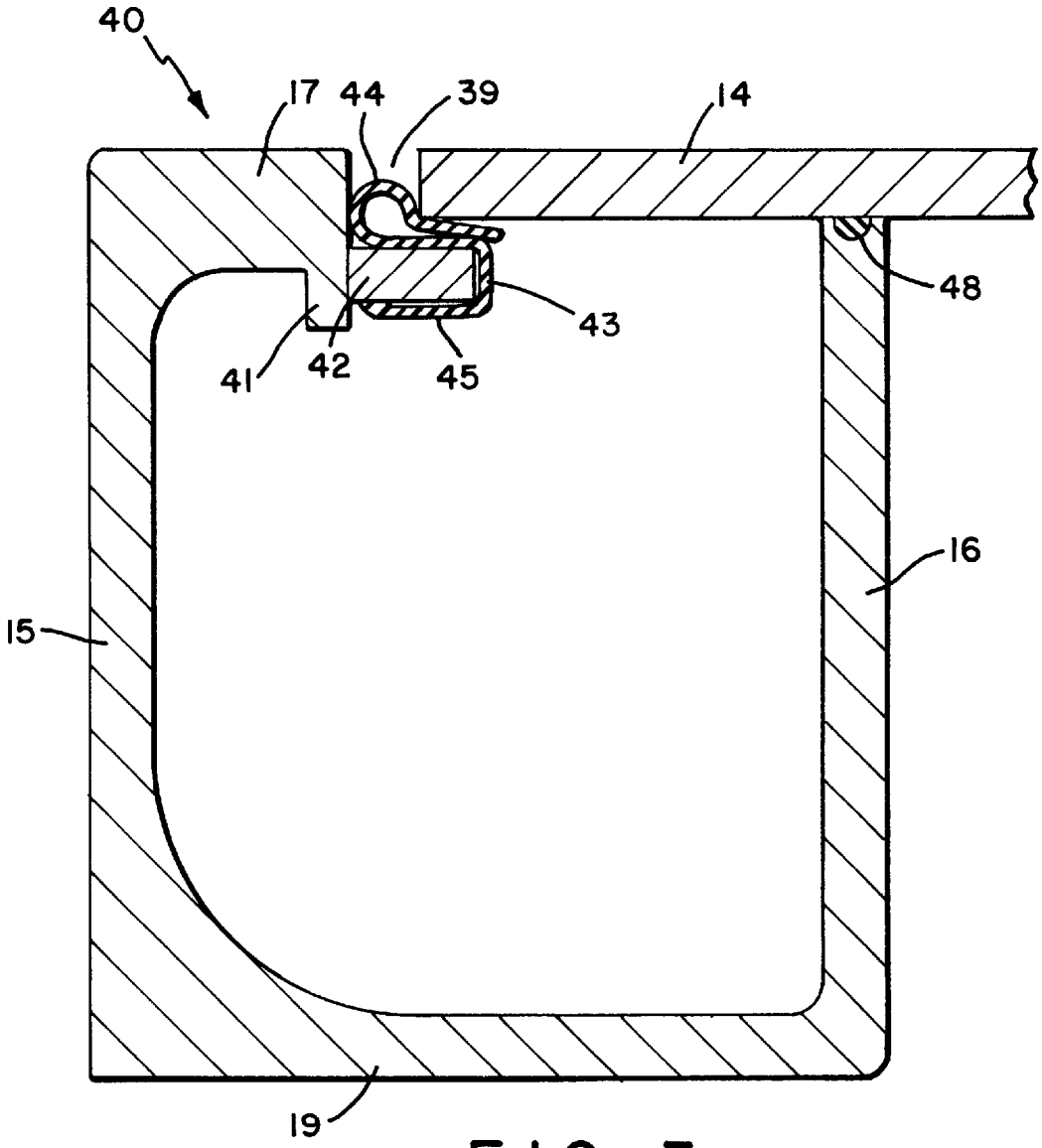
FIG. 3 (PRIOR ART)
FIG. 3 is a partial cross-sectional side view of a prior art channel frame employing a compressible gasket to seal the gap between the frame and door edge.

Referring to FIG. 3, a cross-sectional view of a horizontal door having a prior art compressible gasket is shown. The channel frame 40 has an outer wall 15, an inner opposed wall 16 and a lower connecting wall 19. The channel frame 40 also has an inwardly extending flange 17 at the upper end of outer wall 15. The flange 17 has a downwardly extending member 41 and an inwardly extending confronting flange 42 extending across gap 39 for supporting a gasket. A gasket shown generally as 43 has a lower portion 45 and an upper portion 44 which is secured to flange 42 by a force fit. The upper portion 44 of gasket 43 is shown compressed against confronting flange 42 by the closed door 14. When the door is open, the gasket 43 will be in a relaxed position with the upper surface 44 resting on flange member 42.

The compressible gasket design shown in FIG. 3 has serious drawbacks when compared to the bendable gasket and horizontal door assembly of the present invention. For example, when the door 14 is closed any debris or other matter in the gap between the frame and the door could break flange member 42 or bend channel frame 17 depending on the strength of flange member 42. The compressible gasket 43 is also subjected to severe forces if any debris is on the surface of the gasket when the door is closed.

The horizontal door assembly and gasket system of the present invention overcomes the problems of a compressible gasket since it is only the gasket which is effectively contacted by the door and since the gasket is bendable there is no possibility of the frame being bent or otherwise damaged when the door is closed. The forces on the bendable gasket are also much less than the forces on a compressible gasket and the life of the bendable gasket and horizontal door assembly of the present invention is greatly enhanced compared to the prior art design. The body portion of the bendable gasket is subjected to a bending moment by the door and covers the gap and the gasket may be reinforced to provide long wear. For example, as shown further hereinbelow shoulders may be provided on the gasket at the intersection of the flange opening and the body portion of the gasket. The gasket, when contacted and forced downward by the door, is not in a compressed state and accordingly does not have the severe compressive forces thereon as the compressive gaskets in horizontal door assemblies of the prior art.

Figure 4A:
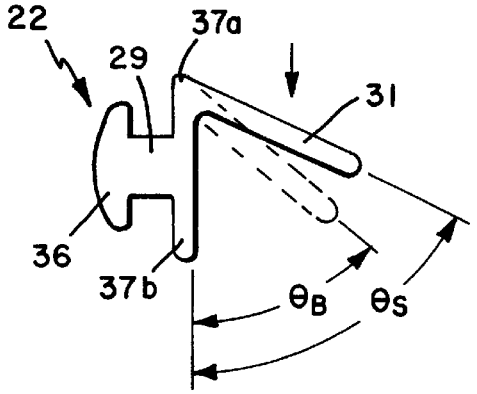
FIGS. 4A and 4B show side views of gaskets of the invention.
Figure 4B:
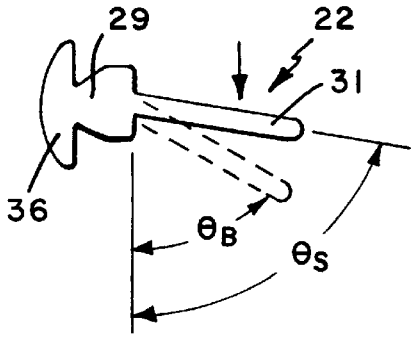

Referring to FIGS. 4A and 4B, two gaskets of the invention are shown. FIG. 4A shows the gasket 22 employed in the door assembly of FIG. 2 and comprises an elongated leg portion 29 having a protuberance 36 at the back end thereof for locking the gasket into the frame. An elongated body portion 31 extends preferably at a downward angle $\theta_s$ and which body portion is bent downward when the door is closed in the direction of the arrow to form an angle $\theta_B$. The gasket has shoulders 37A and 37B which rest against the wall 47 of the frame to provide additional strength to the gasket and enhanced bending life during use of the door assembly.

Referring to FIG. 4B, another gasket 22 of the invention is shown again having an elongated leg portion 29 having a protuberance 36 at the back end thereof. The body portion extends outward from the leg portion and preferably forms a downward angle $\theta_s$ in the relaxed position. When the gasket is bent downward in the direction of the arrow by the closing door, the bent body portion is shown in phantom forming a downward angle $\theta_B$.

Figure 5:
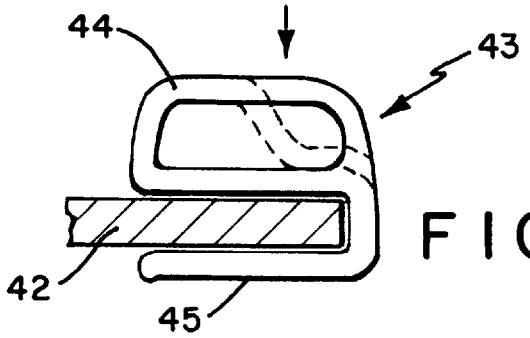
FIG. 5 (PRIOR ART)
FIG. 5 is a side view of a gasket of the prior art.

Referring to FIG. 5, a compressible gasket of the prior art is shown as 43. The gasket has a lower portion 45 and an upper open portion 44. The gasket is secured to the frame of the door by a force fit over an extending flange 42. When the door is closed in the direction of the arrow, the upper portion 44 of the gasket is compressed as shown in phantom. Any dirt or debris on the surface of gasket 43 will also be compressed against the gasket and provides compressive forces against the upper portion 44 of gasket. Also, the upper portion of the gasket 44 is compressed against the flange securing the gasket providing further compressive forces against the gasket. This is to be contracted with the bending forces on the gaskets of the invention shown in FIGS. 4A and 4B.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A horizontal hinge door assembly for enclosing an opening, the door assembly comprising:

a plurality of elongate U-shaped channel frame members having an outer wall with an inner surface, an inner wall being shorter than the outer wall and a connecting lower wall with a channel being formed between the outer wall, inner wall and lower wall, which said frame members are connected together to form a door assembly door frame, the door frame having a front and a back and two opposed sides and having an opening therebetween;

a hinge;

a door having a top, bottom and side edges said door being hingedly mounted to at least one of the two said opposed sides for motion of the door between an open position and a closed position for enclosing the opening, wherein when the door is in the closed position the door rests on the inner wall of the frame member and forms a gap between the inner surface of the outer wall and the side edge of the door which gap is open and extends from the top of the door to the bottom of the door and into the channel;

the frame members having opposed to the side edge of the door when the door is in the closed position at least one gasket opening in the inner surface of the outer wall of at least one of the frame members for securing a gasket to the outer wall; and an elongate gasket to seal the gap when the door is in the closed position comprising a leg portion which is inserted into the gasket opening to secure the gasket to the outer wall and a body portion which extends outwardly from the inner surface of the outer wall of the frame member across the gap toward the inner wall which body portion is contacted by the bottom of the door where the body portion and bottom of the door meet and the gasket is bent and pivoted downward at the juncture of the leg portion and body portion by the bottom of the door when the door is in a closed position so that the body portion is contacted only by the bottom of the door and the body portion extends across the gap sealing the gap and extends under the bottom of the door.

2. The horizontal hinge door assembly of claim 1 wherein the channel frame has a transverse inwardly extending flange at the upper end of the outer wall to which the hinge is attached and in which the gasket opening is formed.

3. The hinge door assembly of claim 1 wherein the gasket opening runs the length of the frame member.

4. The hinge door assembly of claim 3 wherein the gasket opening is laterally opposed to the side edge of the door when the door is in the closed position.

5. The hinge door assembly of claim 1 wherein the body portion of the gasket is sloped downwardly when the door is in the open position and is bent further downward by the door when the door is in the closed position.

* * * * *

UNITED STATES PATENT AND TRADEMARK OFFICE

CERTIFICATE OF CORRECTION

PATENT NO. : 6,260,305 B1
DATED : July 17, 2001
INVENTOR(S) : Roger F. Joyce

It is certified that error appears in the above-identified patent and that said Letters Patent is hereby corrected as shown below:

Title page,
Item [56], add the following references:

| | | | |
|---|---|---|---|
| 1,337,394 | 4/1920 | Dillingham | 49/489.1 |
| 2,051,757 | 8/1936 | Travis | 49/489.1 |
| 2,077,845 | 4/1937 | Madsen | 49/489.1 |
| 2,293,292 | 8/1942 | Goeliner | 49/489.1 |
| 3,535,824 | 10/1970 | Kessler | 49/489.1 |
| 4,999,957 | 3/1991 | Kessler | 49/504 |
| 5,009,036 | 4/1991 | Ryan | 49/489.1 |
| 5,081,793 | 1/1992 | Mauro | 49/504 |
| 5,248,542 | 9/1993 | Hinzpeter et al. | 49/192 |
| 5,293,723 | 3/1994 | Slessor | 49/504 |
| 5,363,611 | 11/1994 | Richardson et al. | 49/504 |
| 5,365,708 | 11/1994 | Winston | 49/504 |
| 5,551,192 | 9/1996 | Avendano et al. | 49/489.1 |
| 5,572,840 | 11/1996 | Fast et al. | 49/504 |
| 5,758,458 | 6/1998 | Ridge | 52/204.1 |

Column 4,
Line 37, of the specification, delete "∫ in" and substitute therefor -- in --.

Column 6, claim 1,
Lines 40-1, delete "door assembly".
Line 54, between "and" and "into" insert therefor -- straight --.

Signed and Sealed this

Fifth Day of February, 2002

*Attest:*

*Attesting Officer*

JAMES E. ROGAN
*Director of the United States Patent and Trademark Office*